US005338631A

United States Patent [19]

Masubuchi

[11] Patent Number: 5,338,631

[45] Date of Patent: Aug. 16, 1994

[54] METHOD OF FORMING COLOR IMAGES

[75] Inventor: Sadao Masubuchi, Chofu, Japan

[73] Assignee: Citizen Watch Co., Ltd., Tokyo, Japan

[21] Appl. No.: 976,295

[22] Filed: Nov. 13, 1992

Related U.S. Application Data

[63] Continuation of Ser. No. 684,935, Apr. 25, 1991, abandoned.

[51] Int. Cl.[5] ..... G03G 13/01

[52] U.S. Cl. ..... 430/42; 430/45; 430/46

[58] Field of Search ..... 430/42, 44, 45, 46

[56] References Cited

U.S. PATENT DOCUMENTS

| | | | |
|---|---|---|---|
| 3,060,019 | 10/1962 | Johnson et al. | 96/1 |
| 4,007,044 | 2/1977 | Shiga | 96/1.2 |
| 4,521,502 | 6/1985 | Sakai et al. | 430/42 |
| 4,542,084 | 9/1985 | Watanabe et al. | 430/46 |
| 4,921,768 | 5/1990 | Kunugi et al. | 430/45 |

FOREIGN PATENT DOCUMENTS

| | | |
|---|---|---|
| 52-75326 | 6/1977 | Japan . |
| 52-149123 | 12/1977 | Japan . |
| 60-144766 | 7/1985 | Japan . |
| 63-285566 | 11/1988 | Japan . |
| 2200913 | 2/1979 | United Kingdom . |
| 22002913A | 2/1979 | United Kingdom . |

*Primary Examiner*—Marion E. McCamish
*Assistant Examiner*—Rosemary Ashton
*Attorney, Agent, or Firm*—Townsend & Townsend Khourie & Crew

[57] ABSTRACT

A one-shot color scheme for forming a color image by one exposure cycle is characterized in that color toners consist of three kinds of color toners for transmitting cyan, magenta, and yellow color components and emitting the same colors as the transmitted color components, red, green, and blue light components whose exposure energy amounts are variable are caused to be incident on the color toners on the photoconductive layer, and the color toners are selectively separated from the photoconductive layer by changing a combination of the color light components and the exposure energy amounts.

9 Claims, 2 Drawing Sheets

METHOD OF FORMING COLOR IMAGES

This is a continuation of application Ser. No. 07/684,935, filed Apr. 25, 1991, now abandoned.

TECHNICAL FIELD

The present invention relates to a method of forming an image according to an electrophotographic scheme and, more particularly, a method of forming an image in accordance with a one-shot color scheme for obtaining an electrostatic latent image corresponding to a color image by one exposure operation.

PRIOR ART

Strong demand has arisen for improving performance of peripheral equipment in correspondence with an increase in a computer data processing capacity. In a printer for presenting processed data to man in the form of a print output, color printing is required to accurately and intuitively express more complicated data.

In order to respond to the above demand, a method of forming a color image using an electrophotographic scheme is proposed. This method has a multi-process scheme and a one-shot scheme.

Electrophotographic color processes of the multi-process are performed as follows. Cyan, magenta, yellow, and black toners are prepared as color toners. An electrostatic latent image corresponding to cyan is formed on the surface of a photoconductive layer, and a cyan toner image is formed. The cyan toner on the surface of the photoconductive layer is transferred to a transfer drum. Magenta, yellow, and black toner images formed in the same process as described above are sequentially superposed on each other on the transfer drum. When transfer of four color toners to the transfer drum is completed, a whole toner image is transferred to a paper sheet and is then fixed to obtain a color print image. According to the conventional method using color toners, the one-page color toner image is formed and is entirely transferred to the paper sheet. For this reason, a transfer drum having a large diameter and a circumferential length corresponding to the length of the paper sheet is required, resulting in a bulky apparatus. In addition, the transfer drum must be rotated by the number of times corresponding to the number of color toners. In this case, the transfer drum must be rotated four times, resulting in a low print speed. If color misregistration occurs during superposition of color toners, image quality is greatly degraded. Therefore, a high-precision mechanical positioning system is required, resulting in high cost.

In order to solve these drawbacks, the one-shot color scheme using the electrophotographic method is proposed. For example, in Japanese Examined Patent Publication (Kokoku) No. 55-27341, a method using special color toners is disclosed. According to the characteristic feature of this one-shot color scheme, the following special toners having nuclei of color filters are used. Each special toner consists of two components having different functions. One component is a color filter for selectively transmitting a color, and the other component is a color former, which reacts with a developer applied to the surface of a recording paper sheet and expresses a complementary color of a transmitted color of the color filter. The color former is transparent before it reacts with the developer. Three special toners having color filters for transmitting red, green, and blue light components, and color formers which react with the developers to express cyan, magenta, and yellow color light components as complementary color components of red, green, and blue, respectively, are used.

A photoconductive layer is charged, and the special toners are applied to the surface of the photoconductive layer to form one layer. The layer of the special toners is exposed with light as a combination of red, green, and blue light components depending on image data. When exposure is completed, an electrostatic attraction force between the photoconductive layer and one of the special toners which contains a color filter for transmitting an exposure color therethrough is decreased. For example, red exposure light is transmitted through a special toner containing a color filter for transmitting red light therethrough and reaches the surface of the photoconductive layer to reduce a charge amount of the corresponding surface portion of the photoconductive layer. On the other hand, since the special toners containing color filters for transmitting green and blue colors absorb red light, red exposure light does not reach the surface of the photoconductive layer, and the charge amount of the corresponding surface portion of the photoconductive layer is not reduced.

In the developing process, only a toner having a small electrostatic attraction force is separated from the photoconductive layer, and a color toner image is foraged on the surface of the photoconductive layer. The special toners left on the photoconductive layer are transferred to a recording paper sheet applied with a developer. The transferred image is fixed to obtain a color image. In the above example, when the special toners are exposed with red light, the special toners for magenta and yellow colors are left on the surface of the photoconductive layer. These two types of toners are transferred to the paper sheet, and a red image is formed on the recording paper sheet. Exposure operations are performed in a combination of light components having different wavelength ranges, so that an image having eight colors including white and black can be obtained.

The conventional one-shot color scheme has the following problems due to use of the special toners:

(a) handling of recording sheets is cumbersome;

(b) special toners are expensive;

(c) residue of special toners is produced; and (d) a color density of an image is insufficiently low.

Problem (a) occurs due to use of special paper having a surface applied with a developer so as to cause a color former of the special toner to develop a corresponding color. Normal paper used in a conventional electrophotographic image forming apparatus does not develop any color, and no image is obtained. Special paper is not easily accessible, and its storage atmosphere must be maintained to prevent denaturing of the developer.

Problem (b) is caused by the complicated fabrication process of special toners. More specifically, nuclei of color filters for selecting transmission colors are formed, and the color formers must be coated on these nuclei, thus resulting in a complicated fabrication process and expensive toners.

Problem (c) is caused by a color filter constituting each special toner and left on the surface of the paper sheet without being fixed since the color of the color filter is complementary with the color developed by the corresponding color former and the color filter is fixed on the sheet as a black image. This residue must be removed.

Problem (d) is caused by a small volume ratio of the color former to the color filter member of each special toner.

Another one-shot scheme using cyan, magenta, and yellow color toners having no nuclei of color filters is disclosed in Japanese Unexamined Patent Publication (Kokai) No. 63-285566. Print colors are a combination of red, green, and blue and are insufficient as colors to be expressed at a color printer. Only red, yellow, and green are expressed by still another one-shot scheme using red, yellow, and green color toners, as disclosed in Japanese Examined Patent Publication (Kokoku) No. 40-28497, and the number of tones to be expressed is insufficiently small.

It is an object of the present invention to provide a method of forming an electrophotographic image, capable of obtaining an electrostatic latent image corresponding to a color image by one exposure operation by a simple arrangement without the conventional problems described above by modifying an exposure method using a conventional color toner having no nuclei of color filters, capable of expressing an image by a large number of colors, and capable of obtaining a high-quality color image on normal paper.

DISCLOSURE OF INVENTION

In order to achieve the above object of the present invention, there is provided a one-shot color scheme for forming a color image by only one exposure operation, characterized in that the color toners consist of three color toners for transmitting cyan, magenta, and yellow and developing the same colors as the transmitted color components, red, green, and blue light components whose exposure energy amounts are variable are caused to be incident on the color toners on the photoconductive layer, and the color toners are selectively separated from the photoconductive layer by changing a combination of color light components and exposure energy amounts.

BEST MODE FOR CARRYING OUT THE INVENTION

The present invention will be described in detail with reference to preferred embodiments.

Embodiment 1

A method of controlling an electrostatic force between a color toner and a photoconductive layer according to an exposure method of the present invention will be described with reference to FIGS. 1(*a*), 1(*b*) and 1(*c*).

A photoconductive layer uses an organic photosemiconductor layer having sensitivities for red, green, and blue light components. The surface of a photoconductive layer is charged. A mono-layer composed of a cyan toner C for transmitting blue light and green light therethrough and absorbing red light, a magenta toner M for transmitting blue light and red light and absorbing green light, and a yellow toner Y for transmitting green light and red light and absorbing blue light are uniformly formed on the charged surface of the photoconductive layer 1. Each color toner mainly consists of a coloring agent for determining a color of the toner, a binding resin for fixing the toner on a recording sheet, and a charge control agent for controlling toner charge characteristics. The coloring agent is a pigment, a dye, a sublimable dye, or the like. The nucleus of the color filter for selecting transmission color light, which is required in the special toner described in reference to the problem of the prior art, is not required in the present invention.

Each of light intensities $I_R$, $I_G$, and $I_B$ is $\frac{1}{2}$ the light intensity required to sufficiently reduce the surface potential and separate the corresponding toner by optically writing an image on the photoconductive layer having toner using red, green, and blue light. $I_R$, $I_G$, and $I_B$ are changed in accordance with transmittances of color toners, exposure time, and photosensitive properties of the photoconductive layer, which can be expressed by mathematical expressions as follows:

$$(2\times I_R)\times T_R\times \Delta t=E_R,$$

$$(2\times I_G)\times T_G\times \Delta t=E_G,$$

$$(2\times I_B)\times T_B\times \Delta t=E_B$$

where $T_R$, $T_G$, and $T_B$ are the transmittances of the color toners for the corresponding light components, which will be described in detail later, $\Delta t$ is the exposure time, and $E_R$, $E_G$, and $E_B$ are the optical energies of the respective color components required to sufficiently reduce the surface potential of the photoconductive layer when the photoconductive layer not applied with color toners is exposed.

The above mathematical expressions have the following meanings. When the color toners are exposed at intensities twice the light intensities $I_R$, $I_G$, and $I_B$, energies of values obtained by multiplying the color toner transmittances with values twice the light intensities $I_R$, $I_G$, and $I_B$ reach the surface of the photoconductive layer. If this exposure continues for the exposure time $\Delta t$, optical energies required to sufficiently reduce the surface potential are obtained on the photoconductive layer.

Figure 4:
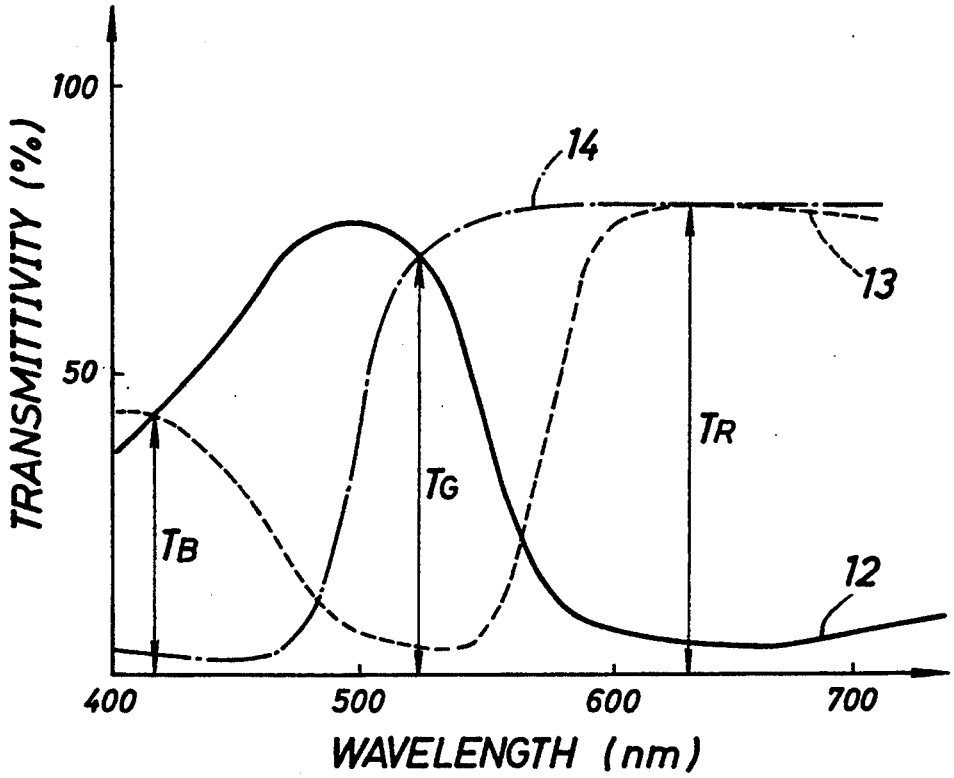
FIG. 4 is a view for explaining transmission spectra of color toners and optical write wavelengths.

The wavelengths of the respective exposure light components of red, green, and blue, and the transmittances of the respective color toners will be described below with reference to FIG. 4.

A transmission spectrum of the cyan toner is represented by 12; a transmission spectrum of the magenta toner, 13; and a transmission spectrum of the yellow toner, 14. Red color exposure is performed using red light having a center wavelength of 640 nm at which the magenta and yellow toners have almost equal transmittances. Green light exposure is performed using green light having a center wavelength of 530 nm at which the cyan and yellow toners have almost equal transmittances. Blue light exposure is performed using blue light having a center wavelength of 415 nm at which the cyan and magenta toners have almost equal transmittances.

$T_R$ is a transmittance of the magenta and yellow toners with respect to the red exposure light described above.

$T_G$ is a transmittance of the cyan and yellow toners with respect to green exposure light. $T_B$ is a transmittance of the cyan and magenta toners with respect to blue exposure light.

Figure 1A:
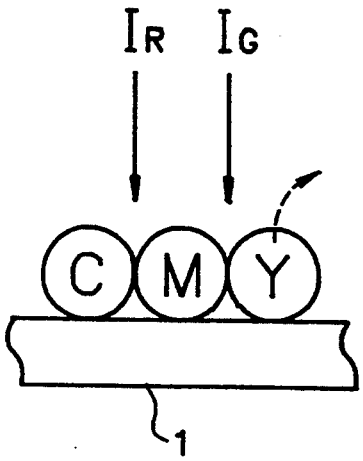
FIGS. 1(*a*), 1(*b*), and 1(*c*) are views for explaining the principle of an exposure method according to the present invention.
Figure 1B:
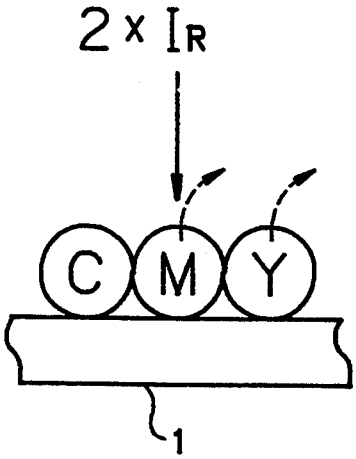
Figure 1C:
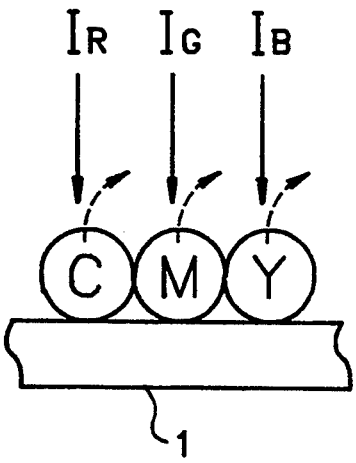

FIG. 1(*a*) shows a case wherein exposure is performed using red light having the light intensity $I_R$ and green light having the light intensity $I_G$. Since the cyan toner C absorbs red light and transmits only green light therethrough, the green light reaches the surface of the photoconductive layer to slightly reduce the charge on the surface of the photoconductive layer, and an electrostatic force between the cyan toner C and the photoconductive layer is slightly reduced. However, since the light intensity $I_G$ is ½ the exposure amount required for reducing the electrostatic force enough to separate the cyan toner form the photoconductive layer in the developing process, the cyan toner is strongly attracted to the photoconductive layer and is not separated in the developing process. The magenta toner M absorbs green light and transmits only red light therethrough. Since the light intensity $I_R$ is ½ the exposure amount required to decrease an electrostatic force enough to separate the magenta toner from the photoconductive layer in the developing process, the magenta toner is not separated from the photoconductive layer in the developing process.

On the other hand, since the yellow toner Y transmits both green light and red light, the surface of the photoconductive layer under the yellow toner Y is exposed with both green light and red light. Two light components each having a light amount of ½ the exposure amount necessary for reducing the electrostatic force enough to separate the yellow toner from the photoconductive layer reach the surface of the photoconductive layer. Therefore, an electrostatic force between the yellow toner and the photoconductive layer can be reduced.

A color toner which transmits one of two exposure light components having different wavelengths is not separated from the photoconductive layer during the developing process. Only a color toner which transmits both the exposure light components having different wavelengths is separated from the photoconductive layer.

When the color toners are exposed with red light having the light intensity $I_R$ and blue light having the light intensity $I_B$, only the magenta toner transmits both red light and blue light therethrough, and an electrostatic force between the photoconductive layer and the magenta toner is greatly reduced. Only the magenta toner can be easily separated from the surface of the photoconductive layer in the developing process.

When the color toners are exposed with green light having the light intensity $I_G$ and blue light having the light intensity $I_B$, only the cyan toner transmits both the green light and the blue light therethrough, and the electrostatic force of only the cyan toner is greatly reduced. Only the cyan toner is easily separated from the surface of the photoconductive layer in the developing process.

That is, when color toners are exposed with two light components having different wavelengths and each having a light amount of ½ the exposure amount necessary for sufficiently reducing the electrostatic force by one-component light, only one kind of color toner capable of transmitting these two light components of exposure light is selected and can be easily separated from the photoconductive layer in the developing process.

A method of selecting two kinds of color toners will be described below. FIG. 1(*b*) shows a case wherein the photoconductive layer is exposed with red light having a light intensity of $2\times I_R$ from the color toner side. Since the cyan toner C absorbs red light, the surface potential of the photoconductive layer under the cyan toner is scarcely decreased. Surface potentials of the photoconductive layer under the magenta and yellow toners M and Y which transmit red light therethrough are greatly decreased. Since the light intensity of $2\times I_R$ is a light amount necessary for decreasing the electrostatic force enough to separate the toner from the photoconductive layer in the developing process, the magenta toner M and the yellow toner Y can be separated from the photoconductive layer in the developing process.

When the color toners are exposed with green light having a light intensity of $2\times I_G$, an electrostatic force between the photoconductive layer and the cyan and yellow toners which transmit green light therethrough is decreased, and these color toners can be easily separated from the photoconductive layer in the developing process. Therefore, only the magenta toner which does to transmit green light therethrough is left on the surface of the photoconductive layer.

When the color toners are exposed with blue light having a light intensity of $2\times I_B$, an electrostatic force between the photoconductive layer and the cyan and magenta toners which transmit blue light therethrough is decreased, and these color toners can be easily separated from the photoconductive layer in the developing process. Therefore, only the yellow toner which does not transmit blue light therethrough is left on the surface of the photoconductive layer.

More specifically, when exposure is performed with light of a single color at an intensity for sufficiently reducing an electrostatic force, two kinds of color toners which transmit the light components of the exposure color are selected and are easily separated from the photoconductive layer in the developing process, and one kind of color toner which does not transmit the light component of the exposure color is left on the surface of the photoconductive layer.

In order to select all the color toners, i.e., three kinds of color toners, the color toners are exposed with red light having the light intensity $I_R$, green light having the light intensity $I_G$, and blue light having the light intensity $I_B$, as shown in FIG. 1(*c*). As described above, insufficient decrease in electrostatic force occurs when the color toners are exposed with one kind of color component. However, when the color toners are exposed with at least two different color light components, the resultant light intensity causes a decrease in electrostatic force enough to separate the toner in the developing process. Upon radiation of blue light and green light, the photoconductive layer under the cyan toner C is subjected to a decrease in electrostatic force enough to separate the cyan toner therefrom in the developing process. When the photoconductive layer under the magenta toner M is irradiated with blue light and red light, an electrostatic force of the corresponding portion is decreased enough to separate the magenta toner M from the photoconductive layer in the developing process. When the photoconductive layer under the yellow toner Y is irradiated with green light and red light, an electrostatic force of the corresponding portion is decreased enough to separate the yellow toner Y from the photoconductive layer in the developing process. In fine, the three kinds of color toners can be easily separated from the photoconductive layer in the developing process.

The color toners separated from the photoconductive layer in the developing process are transferred to a recording sheet in a transfer process. The color toners are then two-dimensionally spread in a fixing process, so that the color toners are superposed on each other and are mixed.

In summary, (1) kinds of exposure light components and their intensities, (2) kinds of color toners separated from the photoconductive layer in the developing process, (3) colors of images obtained by transferring and fixing the separated color toners, (4) kinds of residual color toners left on the photoconductive layer, and (5) colors of images obtained by transferring and fixing residual color toners on the photoconductive layer are summarized in Table 1.

The colors of images obtained by transferring and fixing the color toners separated from the photoconductive layer are complementary to the colors of images obtained by transferring and fixing the residual color toners on the photoconductive layer. In either case, an image of eight colors including white and black can be obtained.

TABLE 1

| (1) Exposure Light | (2) Toner to be Separated | (3) Synthetic color of Toner to be Separated | (4) Residual Toner | (5) Synthetic Color of Residual Toner |
|---|---|---|---|---|
| (1) $I_R + I_G$ | Y | Yellow | C, M | Blue |
| (2) $I_G + I_B$ | C | Cyan | M, Y | Red |
| (3) $I_B + I_R$ | M | Magenta | C, Y | Green |
| (4) $2 \times I_R$ | M, Y | Red | C | Cyan |
| (5) $2 \times I_G$ | C, Y | Green | M | Magenta |
| (6) $2 \times I_B$ | C, M | Blue | Y | Yellow |
| (7) $I_R + I_G + I_B$ | C, M, Y | Black | None | White |
| (8) None | None | White | C, M, Y | Black |

The exposure light must have the light intensities $I_R$, $I_G$, and $I_B$ and intensities twice the light intensities $I_R$, $I_G$, and $I_B$. There are two methods of obtaining the exposure light, i.e., a method of obtaining the different intensity exposure light by changing the optical light intensities, and a method of obtaining the exposure light by changing an exposure time. When an exposure device is an emissive point source such as a laser, the emission light intensity itself is changed, or the light intensity of light emitted by a laser is changed by using an optical modulator. Alternatively, the emission time may be changed while the emission intensity is kept constant. When an emissive array source such as an LED or a fiber optical tube is used, emission intensities of emission dots constituting the array are changed. In this case, the emission time may be changed while the emission intensities are kept constant. When a shutter light source such as a liquid crystal shutter and a PLZT (lead-lanthanum-zirconate-titanate) thio shutter is used, the transmittance of pixels constituting the shutter is changed. The light transmission time may be changed while the transmittance of the shutter pixels is kept constant.

Embodiment 2

Intermediate colors except for blue, cyan, green, yellow, red, and magenta are obtained by the following three methods. The first method is a method using area gradation utilizing a plurality of dots although the pixel resolution is decreased. For example, a plurality of dots, e.g., 4×4 dots are used to constitute a pixel. Each of the cyan, magenta, and yellow toners is used to form a 4×4 dot matrix. When one pixel is constituted by 16 (=4×4) dots, each pixel of cyan, magenta, or yellow can express 16 gray scale levels, so that 4096 colors can be expressed by one pixel. The 16 (=4×4) dots are set in a total of eight states, i.e., three states representing the presence of one of the cyan, magenta, and yellow toners, three states representing the presence of any two of these color toners, a state representing the presence of all the color toners, and a state representing the absence of all the color toners. These eight states correspond to the eight colors described above. Intermediate colors can be obtained by the basic exposure method shown in Table 2.

The second method is a method of expressing intermediate colors by performing area gradation within one dot in units of colors. According to the first method, each color toner is applied to the entire area of each dot or is not applied to the entire area at all. That is, the first method provides only these two states within one dot. However, according to the second method, each color toner is partially applied in an intermediate state between the above two states, i.e., is partially applied to the one-dot area in a given ratio. The second method is realized by digital and analog techniques. The digital technique is a technique by dividing a time required for moving the photoconductive layer by one dot into shorter time intervals, and controlling the exposure time in units of the divided time intervals. When a selected toner color is determined, exposure light is determined on the basis of Table 1, and the exposure times are controlled in units of exposure colors in accordance with the ratios of Y, M, and C toners. For example, when the yellow toner is selected for 50% of the one-dot area and the magenta toner is selected for 30% of the one-dot area, the Y and M toners are selected for 30% of the time required to move the photoconductive layer by one dot in exposure (4) of Table 1, and in addition, only the Y toner is selected for 20% of the time required to move the photoconductive layer by one dot in exposure (1) of Table 1.

The analog technique is performed as follows. The distribution of optical energy obtained by integrating exposure light within one dot is a Gaussian distribution having an optical energy peak at the central position of one dot. A threshold value is set to be an optimal value depending on the exposure light intensities, and the color toner image areas are changed in units of dots, depending on the exposure light intensities. For example, the electrophotographic process can be designed as follows. A color toner image cannot be obtained at the light intensity $I_R$ ($I_G$ or $I_B$). A color toner image is formed in almost the entire area of one dot at the light intensity $2 \times I_R$ ($2 \times I_G$ or $2 \times I_B$). The area of the color toner image is changed depending on intermediate light intensities. This is the process used in an analog color copying machine. Exposure is performed using light components having two different wavelengths, and the light intensity ratio of these two light components is changed to obtain intermediate colors between an image color obtained upon exposure with one light component having a higher light intensity and an image color obtained upon exposure with the other light component having a higher light intensity.

Table 2 shows, in terms of typical ratios of the light intensities of red light and green light when exposure is performed using red light and green light, ① exposure light intensities, ② intensities of light components reaching the surface of the photoconductive layer under each color toner, ③ minimum value ratio of the light intensities of ② to minimum light intensity required to cause the color toners to form an image, ④ kinds of color toners separated from the photoconductive layer, and ⑤ image colors obtained by transferring and fixing the separated color toners. The color toner is separated from the surface of the photoconductive layer when values in the column of ③ are larger than 1. The separation area depends on values of the column of ③, and corresponds to almost the entire one-dot area when the value is 2. A value (0.5) in the column of ④ indicates that the color toner is applied to ½ the one-dot area. The image color is changed in an order of red, orange, yellow, yellowish green, and green in accordance with increases in green light intensities.

Figure 2:
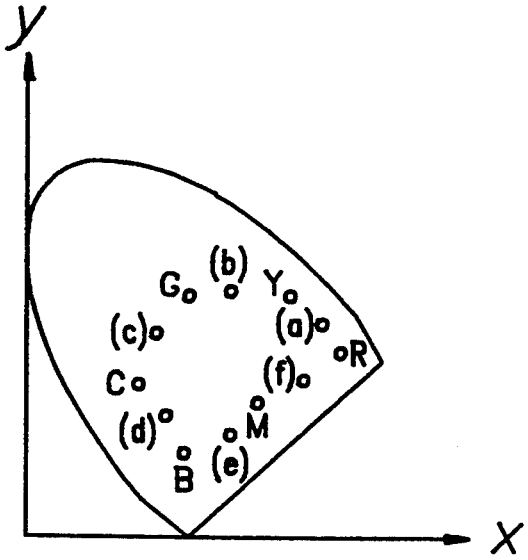
FIG. 2 is a chromaticity chart for explaining hues of colors for expressing an image.

Table 3 shows image colors obtained by exposure in combinations of green light and blue light, and blue light and red light in the same form of Table 2. Symbols (a) to (f) in the column of ⑤ of Table 3 indicate positions in the CIE chromaticity chart in FIG. 2.

TABLE 2

| ① Exposure Light | ② Light Intensity on Surface of Photoconductive Layer | ③ Light Intensity Ratio | ④ Toner to be Separated | ⑤ Synthetic Color of Toner to be Separated |
|---|---|---|---|---|
| $2*I_R$ | C: 0 | 0 | M, Y | Red |
| | M: $2 \times I_R \times T_R$ | 2 | | |
| | Y: $2 \times I_R \times T_R$ | 2 | | |
| $(1.5*I_R + 0.5*I_G)$ | C: $(0.5*I_G \times T_G)$ | 0.5 | M(0.5), Y | Orange (a) |
| | M: $(1.5*I_R \times T_R)$ | 1.5 | | |
| | Y: $(1.5*I_R \times T_R + 0.5*I_G \times T_G)$ | 2 | | |
| $I_R + I_G$ | C: $I_G \times T_G$ | 1 | Y | Yellow |
| | M: $I_R \times T_R$ | 1 | | |
| | Y: $(I_R \times T_R + I_G \times T_G)$ | 2 | | |
| $(0.5*I_R + 1.5*I_G)$ | C: $(1.5*I_G \times T_G)$ | 1.5 | C(0.5), Y | Yellowish Green (b) |
| | M: $(0.5*I_R \times T_R)$ | 0.5 | | |
| | Y: $(0.5*I_R \times T_R + 1.5*I_G \times T_G)$ | 2 | | |
| $2*I_G$ | C: $2*I_G \times T_G$ | 2 | C, Y | Green |
| | M: 0 | 0 | | |
| | Y: $2*I_G \times T_G$ | 2 | | |

TABLE 3

| ① Exposure Light | ② Light Intensity on Surface of Photoconductive Layer | ③ Light Intensity Ratio | ④ Toner to be Separated | ⑤ Synthetic Color of Toner to be Separated |
|---|---|---|---|---|
| $(1.5*I_G + 0.5*I_B)$ | C: $(1.5*I_G \times T_G + 0.5*I_B \times T_B)$ | 2 | C | (c) |
| | M: $(0.5*I_B \times T_B$ | 0.5 | | |
| | Y: $(1.5*I_G \times T_G)$ | 1.5 | Y(0.5) | |
| $(0.5*I_G + 1.5*I_B)$ | C: $(0.5*I_G \times T_G + 1.5*I_B \times T_B)$ | 2 | C | (d) |
| | M: $(1.5*I_B \times T_B)$ | 1.5 | | |
| | Y: $(0.5*I_G \times T_G)$ | 0.5 | M(0.5) | |
| $(1.5*I_B + 0.5*I_R)$ | C: $(1.5*I_B \times T_B)$ | 1.5 | C(0.5) | (e) |
| | M: $(1.5*I_B \times T_B + 0.5*I_R \times T_R)$ | 2 | M | |
| | Y: $(0.5*I_R \times T_R)$ | 0.5 | | |
| $(0.5*I_R + 1.5*I_R)$ | C: $(0.5*I_B \times T_B)$ | 0.5 | | (f) |
| | M: $(0.5*I_B \times T_B +$ | 2 | M | |

TABLE 3-continued

| ① Exposure Light | ② Light Intensity on Surface of Photoconductive Layer | ③ Light Intensity Ratio | ④ Toner to be Separated | ⑤ Synthetic Color of Toner to be Separated |
|---|---|---|---|---|
| | $1.5*I_R \times T_R)$ | | | |
| | Y: $(1.5*I_R \times T_R)$ | 1.5 | Y(0.5) | |

The colors constituted by two kinds of color toners can be obtained by the above exposure method.

In order to increase the range for expressing image colors, images may be constituted by three kinds of color toners. Image colors obtained upon exposure of three kinds of light components, i.e., red light, green light, and blue light are shown in Table 4 in the same form as that of Tables 2 and 3. In this case, column ⑤ in each of Tables 2 and 3 is omitted. In table 4, the sum of light intensities of light components having three different wavelengths is kept constant, and the light intensity ratios of the three light components are changed under the condition that the light intensity of red light is set to be equal to that of green light.

The third method of expressing intermediate colors is a combination of the first and second methods. A pixel is constituted by a plurality of dots while an intermediate color can be expressed by one dot, thereby obtaining a variety of color expressions.

TABLE 4

| ① Exposure Light | ② Light Intensity on Surface of Photoconductive Layer | ③ Light Intensity Ratio | ④ Toner to be Separated |
|---|---|---|---|
| $(I_R + I_G)$ | C: $(I_G \times T_G)$ | 1.0 | |
| | M: $(I_R \times T_R)$ | 1.0 | |
| | Y: $(I_R \times T_R + I_G \times T_G)$ | 2.0 | Y(1) |
| $(0.9*I_R + 0.9*I_G + 0.2*I_B)$ | C: $(0.9*I_G \times T_G + 0.2*I_B \times T_B)$ | 1.1 | C(0.1) |
| | M: $(0.9*I_R \times T_R + 0.2*I_B \times T_B)$ | 1.1 | M(0.1) |
| | Y: $(0.9*I_R \times T_R + 0.9*I_G \times T_G)$ | 1.8 | Y(0.8) |
| $(0.8*I_R + 0.8*I_G + 0.4*I_B)$ | C: $(0.8*I_G \times T_G + 0.4*I_B \times T_B)$ | 1.2 | C(0.2) |
| | M: $(0.8*I_R \times T_R + 0.4*I_B \times T_B)$ | 1.2 | M(0.2) |
| | Y: $(0.8*I_R \times T_R + 0.8*I_G \times T_G)$ | 1.6 | Y(0.6) |
| $(0.7*I_R + 0.7*I_G + 0.6*I_R)$ | C: $(0.7*I_G \times T_G + 0.6*I_B \times T_B)$ | 1.3 | C(0.3) |
| | M: $(0.7*I_R \times T_R + 0.6*I_B \times T_B)$ | 1.3 | M(0.3) |
| | Y: $(0.7*I_R \times T_R + 0.7*I_G \times T_G)$ | 1.4 | Y(0.4) |
| $(0.6*I_R + 0.6*I_G + 0.8*I_B)$ | C: $(0.6*I_G \times T_G + 0.8*I_B \times T_B)$ | 1.4 | C(0.4) |
| | M: $(0.6*I_R \times T_R + 0.8*I_B \times T_B)$ | 1.4 | M(0.4) |
| | Y: $(0.6*I_R \times T_R + 0.6*I_G \times T_G)$ | 1.2 | Y(0.2) |
| $(0.5*I_R + 0.5*I_G + I_B)$ | C: $(0.5*I_G \times T_G + I_B \times T_B)$ | 1.5 | C(0.5) |
| | M: $(0.5*I_R \times T_R + I_B \times T_B)$ | 1.5 | M(0.5) |
| | Y: $(0.5*I_R \times T_R + 0.5*I_G \times T_G)$ | 1.0 | |

Embodiment 3

Eight colors are obtained by a subtractive color mixing method in Embodiment 1. In this embodiment, three colors basic colors are mixed by an additive color mixing method to obtain a total of eight colors including white and black. As shown in FIG. 1(*b*), exposure is performed by using light having a given wavelength range to obtain the basic colors. Results are shown in (4), (5), and (6) in Table 1.

When an image is obtained by color toners separated from the photoconductive layer in the development process, red, green, and blue are obtained as times basic colors in the column of (3) in Table 1. These three basic colors are mixed in accordance with the additive color mixing method to obtain cyan, magenta, and yellow. Each dot is halved, and the three basic colors are located in units of ½ dots. Alternatively, two dots are used to constitute one pixel, and three different basic colors are located in units of dots. For example, red and green are located adjacent to each other and are mixed in accordance with the additive color mixing method to obtain yellow. Although an image obtained by this yellow color is darker than an image obtained by using only a yellow toner, the color can be sufficiently discriminated. When red and blue are located adjacent to each other, magenta can be obtained by the additive color mixing method. When blue and green are located adjacent to each other, cyan can be obtained by this method.

At least two kinds of light components, i.e., red light having a light intensity $2\times I_R$, green light having a light intensity $2\times I_G$, and blue light having a light intensity $2\times I_B$ are selected to perform exposure, or exposure is performed by using light (red light having light intensity $I_R$)+(green light having light intensity $I_G$)+(blue light having light intensity $I_B$), as shown in FIG. 1(*c*), thereby obtaining black. In this case, if exposure is not performed, white can be obtained. By this method, eight colors, i.e., cyan, magenta, yellow, red, green, blue, white, and black can be obtained.

The three basic colors for forming an image by transferring and fixing color toners left on the photoconductive layer upon the development process are cyan, magenta, and yellow listed in the column of (5) of Table 1. These three basic colors are mixed by the additive color mixing method to obtain red, green, and blue. For example, cyan and magenta are located adjacent to each other and mixed by the additive color mixing method to obtain blue. This blue color has a smaller saturation value than blue obtained by superposing cyan and magenta and mixing them by the subtractive color mixing method, but can be sufficiently discriminated. When magenta and yellow are located adjacent to each other and are mixed by the additive color mixing method, red can be expressed by the additive color mixing method. When cyan and yellow are located adjacent to each other, green can be expressed by this method.

Exposure is performed by selecting at least two kinds of light components, i.e., red light having the light intensity $2\times I_R$, green light having the light intensity $2\times I_G$, and blue light having the light intensity $2\times I_B$, or exposure is performed using light (red light having light intensity $I_R$)+(green light having light intensity $I_G$)+(blue light having light intensity $I_B$), as shown in FIG. 1(*c*), thereby obtaining white. In this case, if exposure is not performed, black can be obtained. By this method, eight colors, i.e., cyan, magenta, yellow, red, green, blue, white, and black can be obtained.

Embodiment 4

Figure 3:
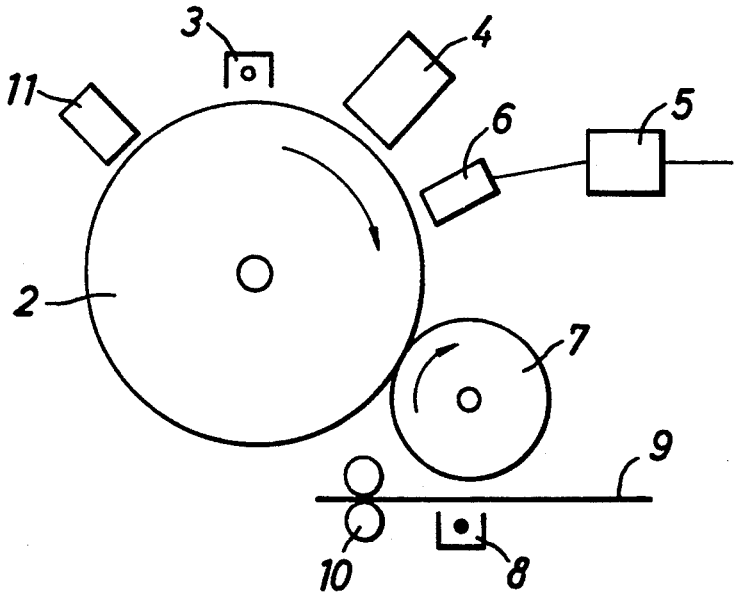
FIG. 3 is a view showing an arrangement of an electrophotographic image forming apparatus according to the present invention.

An arrangement of an electrophotographic color printer using the above exposure method as its exposure process is shown in FIG. 3. The entire surface of an OPC photosensitive drum 2 having panchromatic spectral sensitivity characteristics is charged by a charger 3.

In order to form a good electrostatic latent image by the exposure method of the present invention, the photosensitive drum must have a sufficiently steep $\gamma$ characteristic curve for latent images. As described in detail in reference to Embodiment 1, when exposure is performed using red light having the light intensity $I_R$ and blue light having the light intensity $I_B$, the red light and the blue light pass through the magenta toner and reach the surface of the photoconductive layer under this magenta toner. Only blue light reaches the photoconductive layer under the cyan toner, and only red light reaches the photoconductive layer under the yellow toner. In order to obtain a good image, it is preferable to sufficiently decrease a surface potential of the photoconductive layer under the magenta toner, while the surface potentials of the photoconductive layer under the cyan and yellow toners are not almost decreased. The intensity of light reaching the surface of the photoconductive layer through a selected color toner is two times the intensity of light through a non-selected color toner. In order to obtain a high-quality image, it is desirable that the photoconductive layer has a $\gamma$ characteristic to obtain a sufficiently large surface potential difference when the contrast ratio of light reaching the surface of the photoconductive layer is 2. For example, a digital type photoconductive layer disclosed in Japanese Unexamined Patent Publication (Kokai) No. 1-169454 is effective as the photoconductive layer of the present invention.

The cyan, magenta, and yellow toners are formed as a single layer on the surface of the charged photosensitive drum 2 by a color toner applicator 4. In order to form the color toners in the form of a single layer, it is effective to cover the surface of each color toner with a conductive film of copper iodide or the like to render the color toner surface conductive.

Image data is processed by an image processor 5 and is converted into a signal for driving an optical write head 6. The optical write head comprises a liquid crystal shutter. In order to independently control red light, green light, and blue light by the liquid crystal shutter, a color filter for transmitting red light, green light, and blue light is arranged in each liquid crystal pixel constituting the liquid crystal shutter, and transmittances of the liquid crystal pixels are independently controlled as disclosed in Japanese Unexamined Patent Publication (Kokai) No. 59-137930. In Japanese Unexamined Patent Publication (Kokai) No. 59-137930, each liquid crystal pixel having a color filter for transmitting red light, green light, and blue light is arranged in a moving direction of the photosensitive drum. In this embodiment, in order to increase a print speed, two liquid crystal pixels each having a color filter for transmitting red light, green light, and blue light are arranged in units of transmission colors along the moving direction of the photosensitive drum.

In order to obtain a color print on an A4 sheet at a dot resolution of 300 dpi, the number of liquid crystal pixels must be 7680, which is three times 2560 liquid crystal pixels required to perform optical write access in a black-and-white printer. When these liquid crystal pixels are statically driven, a large number of drive ICs are required. The volume of the optical write head and its cost are undesirably increased. It is effective to drive the liquid crystal pixels with multiplex mode to reduce the number of drive ICs. In order to effectively utilize the optical energy, a liquid crystal capable of memorizing an optical state obtained upon multiplex driving is suitable. When a response speed of the liquid crystal pixel is high, high-speed printing can be performed. Judging from the above conditions, a ferroelectric liquid crystal having a memory function at high speed is used as a liquid crystal material.

As disclosed in Japanese Unexamined Patent Publication No. 61-52630, the ferroelectric liquid crystal is driven by an analog voltage to control it in an intermediate state between a 100% transmittance and a 0% transmittance in an analog manner. In this embodiment, charges corresponding to positive and negative analog voltages for driving the liquid crystal pixels are respectively stored in capacitors arranged in units of output terminals of each drive IC, and the capacitors are switched in synchronism with drive timings and are selectively connected to buffer amplifiers arranged in each drive IC in units of output terminals, thereby selectively driving the liquid crystal pixels. Exposure is performed by the liquid crystal shutter head in accordance with the image data, and the charge of the photoconductive layer under the selected color toner is controlled, thereby controlling an electrostatic force between the selected color toner and the photoconductive layer. The exposure light intensity $I_R$ corresponds to a half open state of the liquid crystal pixel, and the exposure light intensity $2\times I_R$ corresponds to a full open state of the liquid crystal pixel, thereby providing a difference in exposure light amount. In addition, intermediate light intensities are obtained by changing the analog voltages applied to the liquid crystal pixels. The intermediate values of the light intensities are also obtained by a time gradation method. Each liquid crystal pixel is set in a full open or closed state. The liquid crystal pixel is set in a light-transmitting state for ½ the period for moving the photoconductive layer by one line and is set in a light-shielding state for the remaining time. In addition, the intermediate light intensities are obtained by changing the ratio of the times of the light-transmitting and light-shielding states of the liquid crystal pixel. The time gradation can be combined with analog gradation to finely control the exposure light amount.

A color toner whose electrostatic force is decreased can be transferred to a charged transfer drum 7 and is then transferred to a recording sheet 9 by using a transfer corona charger 8. The image is then fixed on the sheet by a heat fixing unit 10. The color toner left on the surface of the photoconductive layer 2 without being transferred to the sheet is scraped by a cleaner 11. The removed color toner is fed to the color toner applicator 4 and is used again. The image may be directly transferred to the recording sheet without using the transfer drum, i.e., without transferring the image on the recording sheet through the transfer drum 7.

Although the image is formed using color toners whose electrostatic force is reduced with respect to the photoconductive layer, an image may be formed using the color toner left on the surface of the photoconductive layer upon completion of the development process. Note that since an image is obtained by complementary colors of exposure light components in this case, the opening/closing timings of signals for driving the optical write head for the liquid crystal pixels must be reversed as opposed to the use of the color toners separated from the photoconductive layer.

Since consumption amounts of three kinds of color toner are different from each other, the ratio of the color toners in the color toner applicator 4 is changed with an increase in number of prints. The amounts of the color toners in the color toner applicator 4 are measured by using light-emitting diodes and light-receiving sensors, and the color toners are automatically replenished so that the ratio of the color toners is kept constant. The consumption amounts of the color toners may be calculated in accordance with print data, and the toners may be replenished on the basis of the calculation results.

Optical write access using a liquid crystal shutter of this embodiment may be performed by using a color fiber optical tube. Alternatively, output light from a white gas laser may be separated into red, green, and blue, and a polygonal mirror may be used to write information. Furthermore, a combination of a semiconductor laser and a harmonic generator may be used. That is, exposure may be performed by scanning a first semiconductor laser for emitting red light, a second semiconductor laser for emitting green light obtained by passing through a 2nd-order harmonic generator a laser beam having a wavelength of 1.06 μm obtained by exciting a YAG laser by a semiconductor laser, and a third semiconductor laser for emitting blue light obtained by passing through a 2nd-order harmonic generator output light of a semiconductor laser having an emission wavelength of 0.83 μm.

According to the present invention, since an image can be formed by one-shot exposure, a transfer drum for transferring a toner image can be omitted, high-precision mechanical positioning is not required, and the apparatus is made compact. In addition, ordinary color toners which do not require nuclei of color filters, i.e., which are different from special color toners, are used, special paper need not be used, and plain paper which is easily accessible and easy to handle can be used. Furthermore, an optical write head having no movable parts and having high dot positioning precision is used to perform one-shot optical write access, thereby obtaining an electrophotographic color printer capable of performing high image positioning precision and printing high-quality color image.

I claim:

1. A color image forming method by applying light-transmitting color toners of a plurality of colors on an photoconductive layer in the form of a single layer, exposing said photoconductive layer from a color toner side, and developing the exposed color toners, and transferring a developed image to a transfer drum or a recording sheet, characterized in that the color toners consist of three kinds of color toners for transmitting cyan, magenta, and yellow color components and expressing the same colors as the transmitted color components, wherein said exposing includes exposing to red, green, and blue light components whose exposure energy amounts are variable and are caused to be incident on the color toners on said photoconductive layer, wherein the color toners forming a positive image are selectively separated from said photoconductive layer by changing a combination of the color light components and the exposure energy amounts to selectively remove all, one, two or none of said three kinds of color toners in a particular first region of said photoconductive layer to provide a first color in said first region and to selectively remove all one, two or none of said three kinds of color toners in a second region to simultaneously provide a second color different from said first color in said second region wherein separation of only one kind of color toner in said first and second regions results from exposure of said first and second regions respectively to two colors of said raid, green and blue light, each having a first intensity and wherein separation of two kinds of color toner in said first and second regions results from exposure of said first and second regions respectively to one color of said red, green and blue light having an intensity of about twice said first intensity.

2. A color image forming method according to claim 1, wherein when the cyan, magenta, or yellow toner for transmitting the respective color components is exposed with two colors of said red, green, and blue light, each having a first intensity, said first intensity is ½ of an optical energy amount enough to separate each toner from said photoconductive layer.

3. A color image forming method according to claim 1, characterized in that exposure is performed by using a red light component having as a center wavelength a wavelength at which transmittances of the magenta and yellow toners are equal to each other, a green light component having as a center wavelength a wavelength at which transmittances of the cyan and yellow toners are equal to each other, and a blue light component having as a center wavelength a wavelength at which transmittances of the cyan and magenta toners are equal to each other.

4. A color image forming method, as claimed in claim 1, wherein the color toners which are separated from the photoconductive layer are used to form an image.

5. A color image forming method, as claimed in claim 4, wherein the colors of the image obtained using the separated color toners are complementary to the colors of the toners remaining in said photoconductive layer.

6. A color image forming method, as claimed in claim 1, wherein the colors toners which remain in said photoconductive layer after some color toners are selectively separated are used to form an image.

7. A color image forming method, as claimed in claim 6, wherein the colors of the image obtained using the toners remaining in said photoconductive layer are complementary to the colors of the toners separated from said photoconductive layer.

8. A color image forming method, as claimed in claim 1, wherein an image can be formed from either the color toners separated from the photoconductive layer or the color toners remaining in said photoconductive layer.

9. A color image forming method, as claimed in claim 8, wherein the colors of the image formed from the color toners separated from the photoconductive layer are complementary in said photoconductive layer.

* * * * *